United States Patent [19]

Venturini et al.

[11] Patent Number: 5,039,068

[45] Date of Patent: Aug. 13, 1991

[54] MACHINE FOR DRILLING TAPHOLES OF A SHAFT FURNACE

[75] Inventors: Severino Venturini, Obercorn; Jean Metz, Luxembourg; Pierre Mailliet, Howald, all of Luxembourg

[73] Assignee: Paul Wurth S.A, Luxembourg, Luxembourg

[21] Appl. No.: 334,264

[22] Filed: Apr. 6, 1989

[30] Foreign Application Priority Data

Apr. 6, 1988 [LU] Luxembourg ..... 87190

[51] Int. Cl.[5] ..... C21B 7/12

[52] U.S. Cl. ..... 266/271; 175/203

[58] Field of Search ..... 266/45, 271-273, 266/269; 414/14, 17, 745.1, 746.8; 175/203, 135, 320; 166/77.5, 85; 81/451; 173/39

[56] References Cited

U.S. PATENT DOCUMENTS 4,418,894 12/1983 Mailliet ..... 266/45 X

FOREIGN PATENT DOCUMENTS 64644 11/1982 European Pat. Off. ..... 266/271

122844 10/1984 European Pat. Off. ..... 266/271

*Primary Examiner*—Larry I. Schwartz

*Assistant Examiner*—Robert Schultz

*Attorney, Agent, or Firm*—Fishman, Dionne & Cantor

[57] ABSTRACT

A machine for opening tapholes has a conical guide and support head which is slidably mounted on a mount and which includes at least one hook equipped with two mutally opposite catching slots. The catching slots allow the hook to occupy two catching positions. In the first catching position, the head is secured to a sliding frame displacable by use of a sliding carriage. In the second catching position, the head is secured to the front end of the mount.

5 Claims, 8 Drawing Sheets

20
46
48
42
52
54
56
34
32
40
36

34
50
50
48
42'
42
44
36
28
0

A
32
34
20
46
42
28
26

32
34
48
50
42'
42
50
44
36
28
0
26

MACHINE FOR DRILLING TAPHOLES OF A SHAFT FURNACE

BACKGROUND OF THE INVENTION

This invention relates to a machine for drilling or forming tapholes of a shaft furnace. More particularly, this invention relates to a taphole drilling machine intended both for conventional drilling by means of a bit and for carrying out a process in which the closing and opening of the taphole involve the respective operations of introducing a drillrod to a taphole and extracting a drill rod which is left behind in the mass of the taphole between two successive pourings. The drilling machine of this invention includes a mount attached to the free end of a pivoting supporting arm, a carriage sliding along the mount and carrying a working tool, a device for coupling the drill rod to the working tool, and a conical head for guiding and supporting the drill rod.

A drilling machine of the type described, above is disclosed in French Pat. No. 2,494,414 corresponding to U.S. Pat. No. 4,418,894. To make it easier to engage the machine on the drill rod in order to extract it, a support and guide head which diverges frustonconically in the direction of the furnace is provided at the front end of the mount. However, this support and guide head has not proven sufficiently effective when the axis of the work tool, as it approaches the drill rod, is still not entirely in the extension of the drill rod. In most cases, the guide head is even an obstacle to the correct positioning of the drilling machine for the purpose of coupling to the drill rod. Another disadvantage of this prior art machine is that, at the moment when the rod is extracted and before the return of the machine, the frustoconical guide and support head is exposed to jets and splashes of liquid metal, thus causing rapid damage to the head.

SUMMARY OF THE INVENTION

The above discussed and other disadvantages and problems of the prior art are overcome or alleviated by the drilling machine of the present invention. In accordance with the present invention, a novel drilling machine is presented which like the prior art, possesses a frustoconical guide and support head, but unlike the prior art, does not have the disadvantages mentioned above. In a preferred embodiment of the present invention, a guide and support head is slidably mounted on the mount and has at least one hook equipped with two mutually opposite catching slots allowing the hooks to occupy two catching positions. In the first catching position, the head is secured to a sliding frame displacable by means of the carriage. In the second catching position, the head is secured to the front end of the mount.

Because of the possibility of sliding of the guide and support head, the latter can be retracted so that it does not cause an obstruction during the positioning of the machine for the extraction of the drill rod. Once the machine is in place, this head can be advanced, and by means of its frustoconical guide apron, it performs its function in full for easy engagement on the free end of the drill rod located in the furnace and for coupling the drill rod to the work tool. Furthermore, because of the presence of the hooks, the displacement of the guide and support head takes place automatically as a result of the displacement of the carriage of the working tool.

During the extraction of the drill rod, the guide and support head remains caught on the sliding frame and on the carriage and, as a result of the return movement of the latter, is automatically moved away from the danger zone of splashes and jets of molten metal.

The guide and support head preferably comprises two hooks arranged symmetrically on either side of the axis of the mount on a common transverse shaft.

The sliding frame preferably comprises a crossbar which is engaged by one of the slots of the hooks. The sliding frame also includes support blocks slidably attached to the mount, and stops located at the front and rear so as to be driven together with the carriage on which the working tool is mounted.

Each hook preferably has a slope, with which the crossbar of the sliding frame interacts in order to lift the hooks and cause them to automatically catch on the bar during the advance of the carriage and frame; and when the hooks occupy the second position. At least one of the hooks is equipped with handles for the manual pivoting of the hooks from the first position towards the second position, and vice versa.

The above-discussed and other features and advantages of the the present invention will be appreciated and understood by those skilled in the art from the following detailed description and drawings:

BRIEF DESCRIPTION OF THE DRAWINGS

Referring now to the drawings wherein like elements are numbered alike in the several FIGURES:

FIG. 4;

DESCRIPTION OF THE PREFERRED EMBODIMENT

Figure 1:
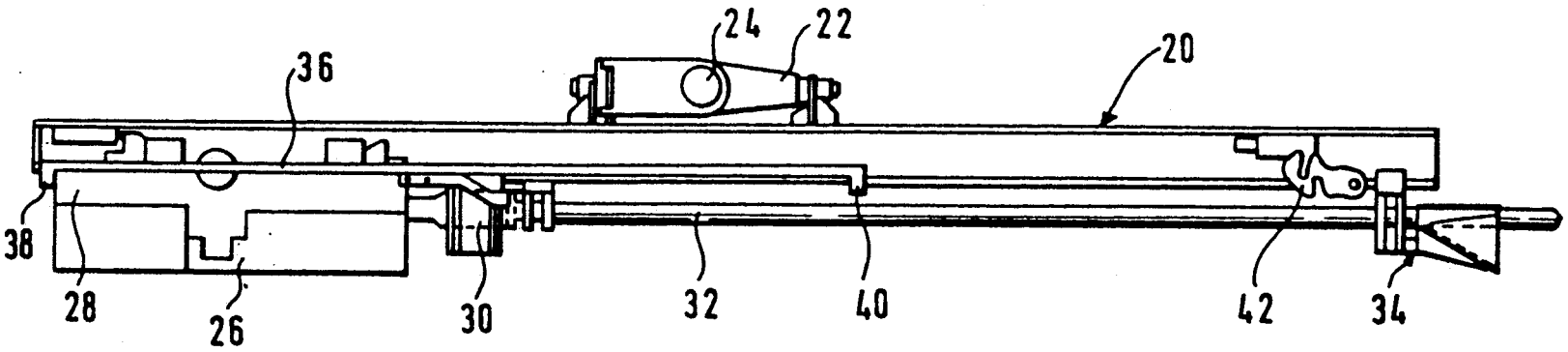
FIG. 1 is a diagrammatic side elevation view of a machine in accordance with the present invention.

FIG. 1 depicts a mount 20 attached by means of a support 22 to the supporting arm 24 of a machine for the drilling of a taphole. A working tool 26 is slidably mounted on a carriage 28 for sliding along the mount under the action of drive means (not shown) which, for example, can consist of an endless chain. Located at the front of the working tool 26 is a device 30 for coupling the working tool 26 to a drill rod 32. This drill rod 32 is supported and guided at the front of the mount 20 by means of a conical guide and support head which is similar to that described in U.S. Pat. No. 4,418,894, but which, contrary to the known machine, can slide along the mount 20, as will be described in more detail hereinafter. The reference numeral 36 denotes a frame which is fastened underneath mount 20 so as to be capable of sliding along the latter. This frame has a rear stop 38 and a front stop 40. Frame 36 is driven via stops 38, 40 by means of carriage 28 when the latter, during its sliding movement, comes in contact with one of stops 38 or 40. The reference numeral 42 denotes a hook which makes it possible either to catch head 34 on mount 20 or to catch it on frame 36 in order to cause the head to slide along mount 20 together with carriage 28.

When carriage 28 and working tool 26 are advanced, (e.g. moved to the right in FIG. 1), beyond a certain position, carriage 28 comes in contact with stop 40. From that moment on carriage 28 pushes frame 36 ahead of it. Stop 40 can comprise a crossbar 44 which connects two outer longitudinal bars and which is fastened to mount 20 by means of sliding blocks (see FIGS. 2 and 3).

Figure 2:
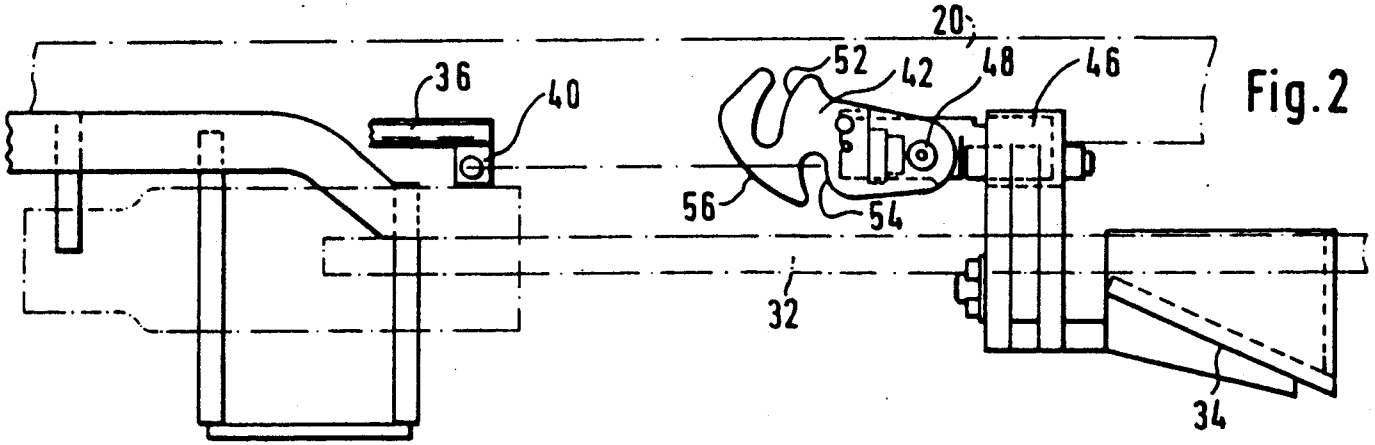
FIG. 2 is an enlarged side elevation view of the part of the mount with the guide and support head thereon.
Figure 3:
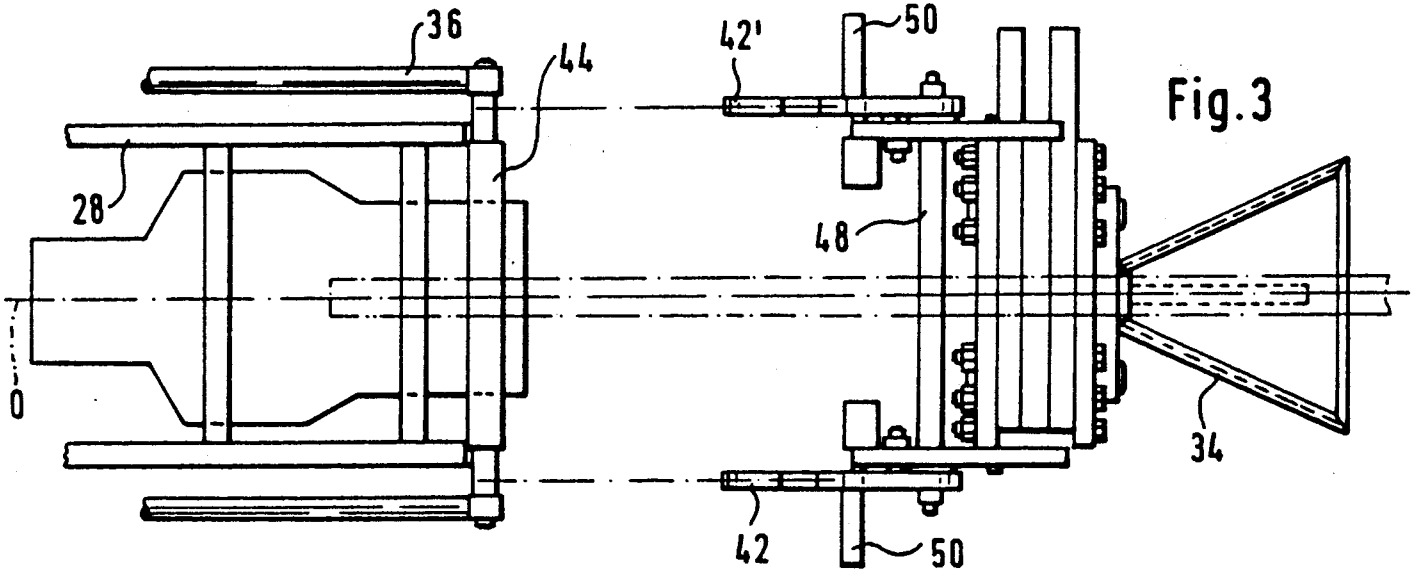
FIG. 3 is a plan view of the apparatus shown in FIG. 2.
Figure 4:
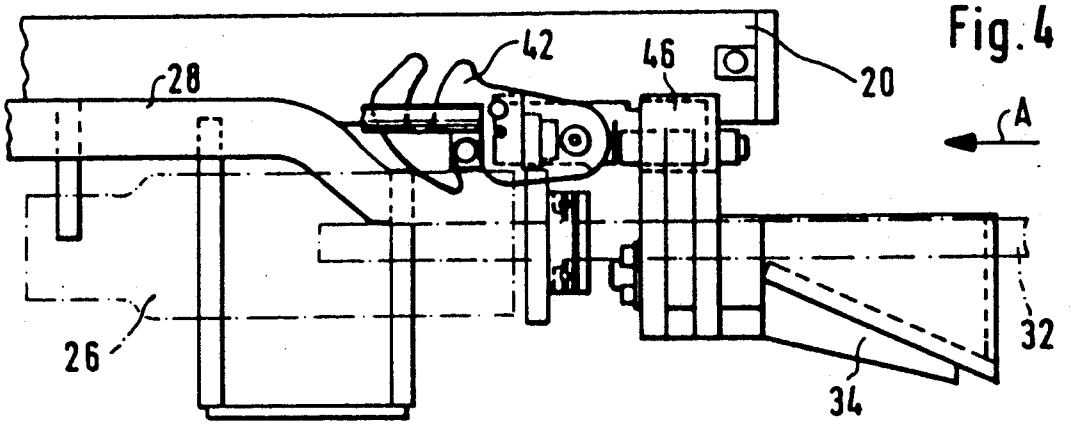
FIG. 4 is a side elevation view of the guide head in the catching position on the sliding frame.
Figure 5:
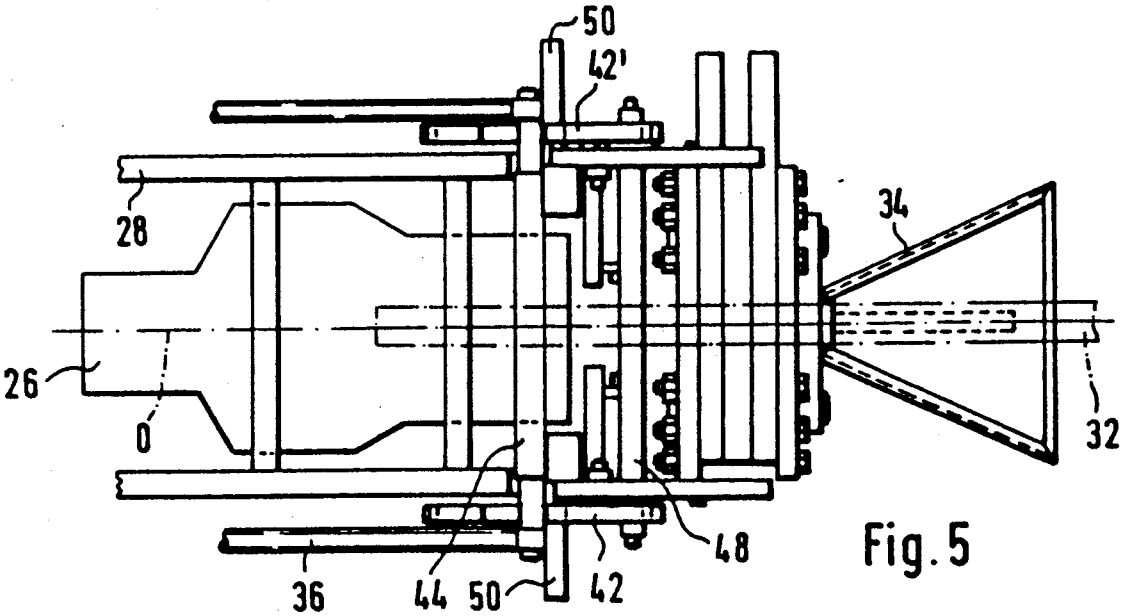
FIG. 5 is a plan view of the apparatus shown in FIG. 4.

The guide and support head 34 is likewise attached to mount 20 by means of sliding block 46. The assembly formed by head 34 and by the block 46 also possesses at least one, but preferably two, hooks 42, 42' mounted symmetrically relative to the longitudinal axis 0 on a common shaft 48 which can pivot about its longitudinal axis together with the hooks 42, 42'. This pivoting is carried out manually, and for this purpose, hooks 42, 42' are equipped with handles 50. Each of hooks 42, 42' possesses two mutually opposite slots 52, 54, as shown in FIG. 2. The hooks 42, 42. also have a rounded part configured in the form of a slope 56. During the advance of sliding frame 36 under the action of carriage 28, crossbar 44 of frame 36 comes in contact with slopes 56 of each of hooks 42, 42', in order to lift these until hooks 42, 42. fall into crossbar 44 by means of slot 54, thus ensuring an automatic catching of head 34 on sliding frame 36, as shown in FIGS. 4 and 5.

Figure 7:
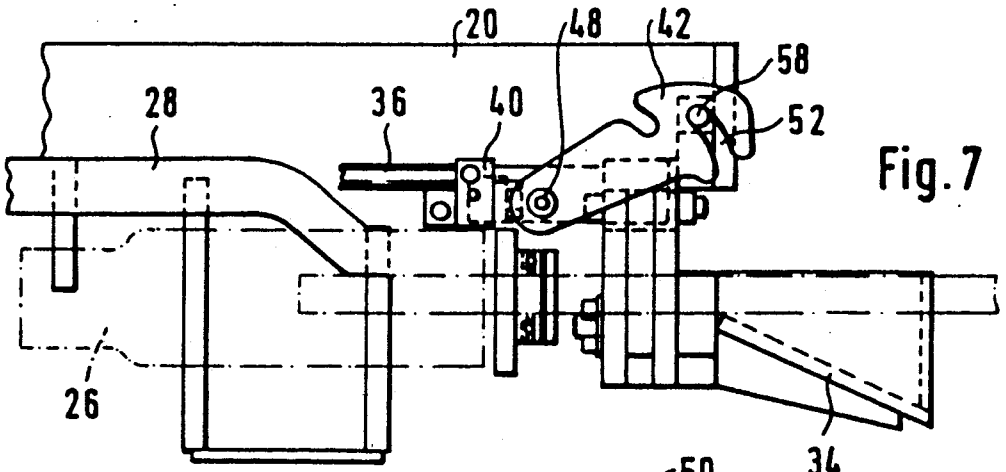
FIGS. 7 and 8 are side and plan views, respectively, which are similar to those of FIGS. 4 and 5, the support head being caught on the first mount.
Figure 8:
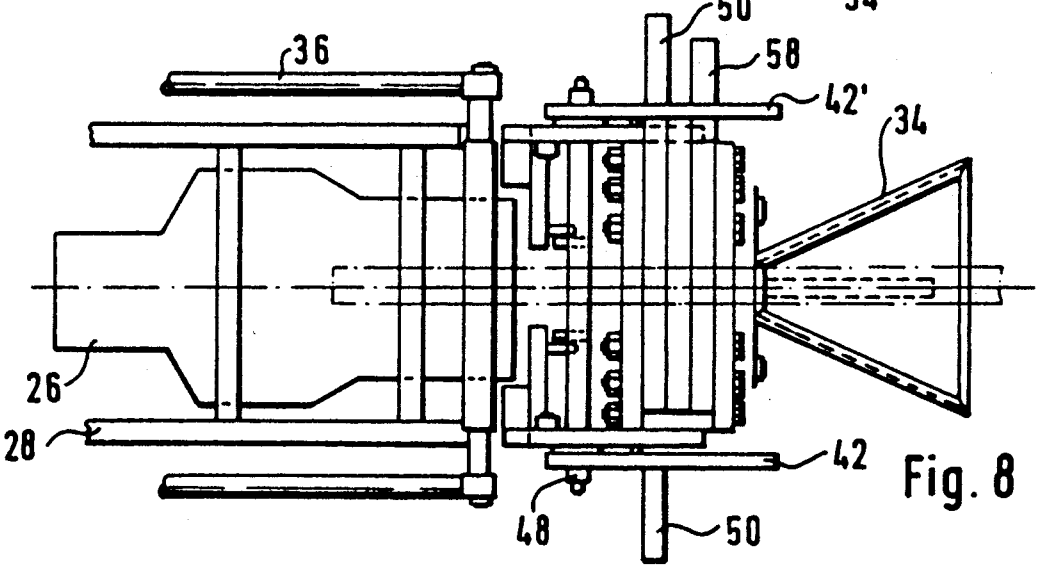

Head 34 is released from frame 36 simply by lifting hooks 42, 42' sufficiently to free bar 44 from slot 54, and after the return of frame 36, the hook can remain in the position according to FIG. 2. Hooks 42, 42. can also be pivoted into the position shown in FIGS. 7 and 8, until slot 52 of one of the hooks 42 or 42' engages in a finger 58 fastened to mount 20. It is also possible to provide a second finger on mount 20 opposite finger 58 shown in FIG. 8, in order to interact with slot 52 of the other hook. In the position according to FIGS. 7 and 8, head 34 is therefore secured to mount 20 and can be released from it only manually. It should be noted that the two hooks 42, 42' can be manually actuated by means of one of the handles 50, because shaft 48 fixes the two hooks 42, 42' to one another.

Figure 6:
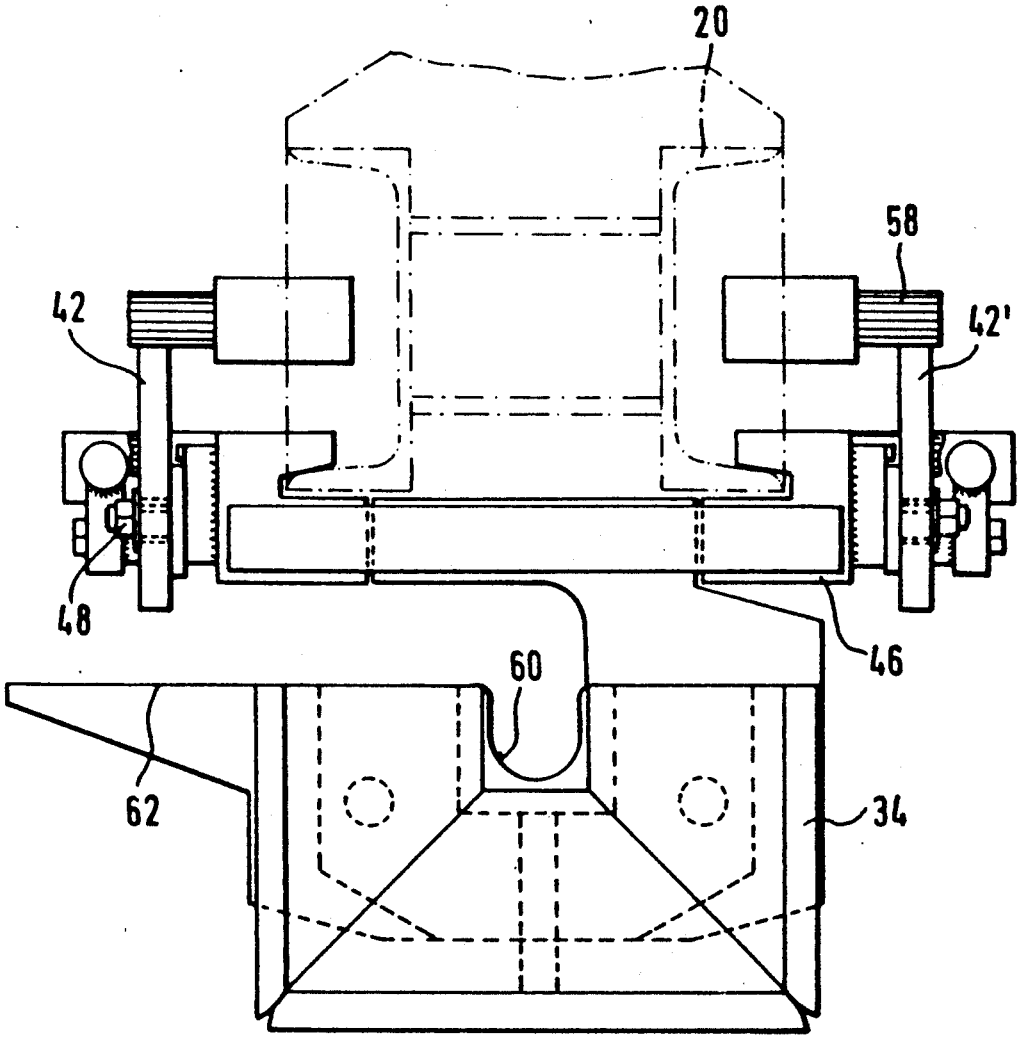
FIG. 6 is an axial view in the direction of the arrow A in 10.

FIG. 6 shows the frustoconical guide and support head 34 in a front view. As can be seen, head 34 is preferably configured in the form of a hook with a central receptacle 60 for the drill rod, this receptacle opening laterally onto a support apron 62, to make it easier for the drill rod to engage laterally into receptacle 60. FIG. 6 also shows how head 34 is supported on the profile of mount 20 by means of sliding block 46.

Figure 9:
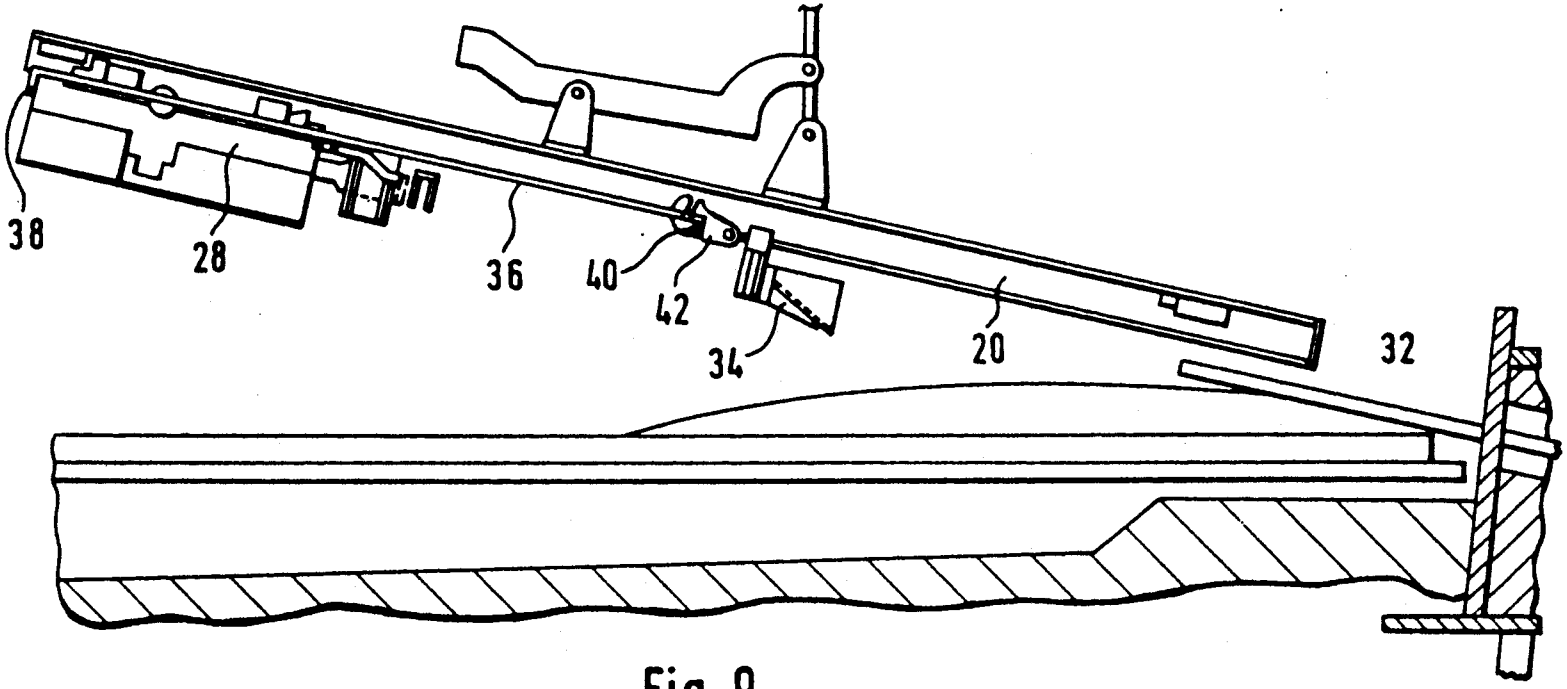
FIG. 9 is a side view of the machine of FIG. 1 in the working position for the extraction of a drill rod.
Figure 10:
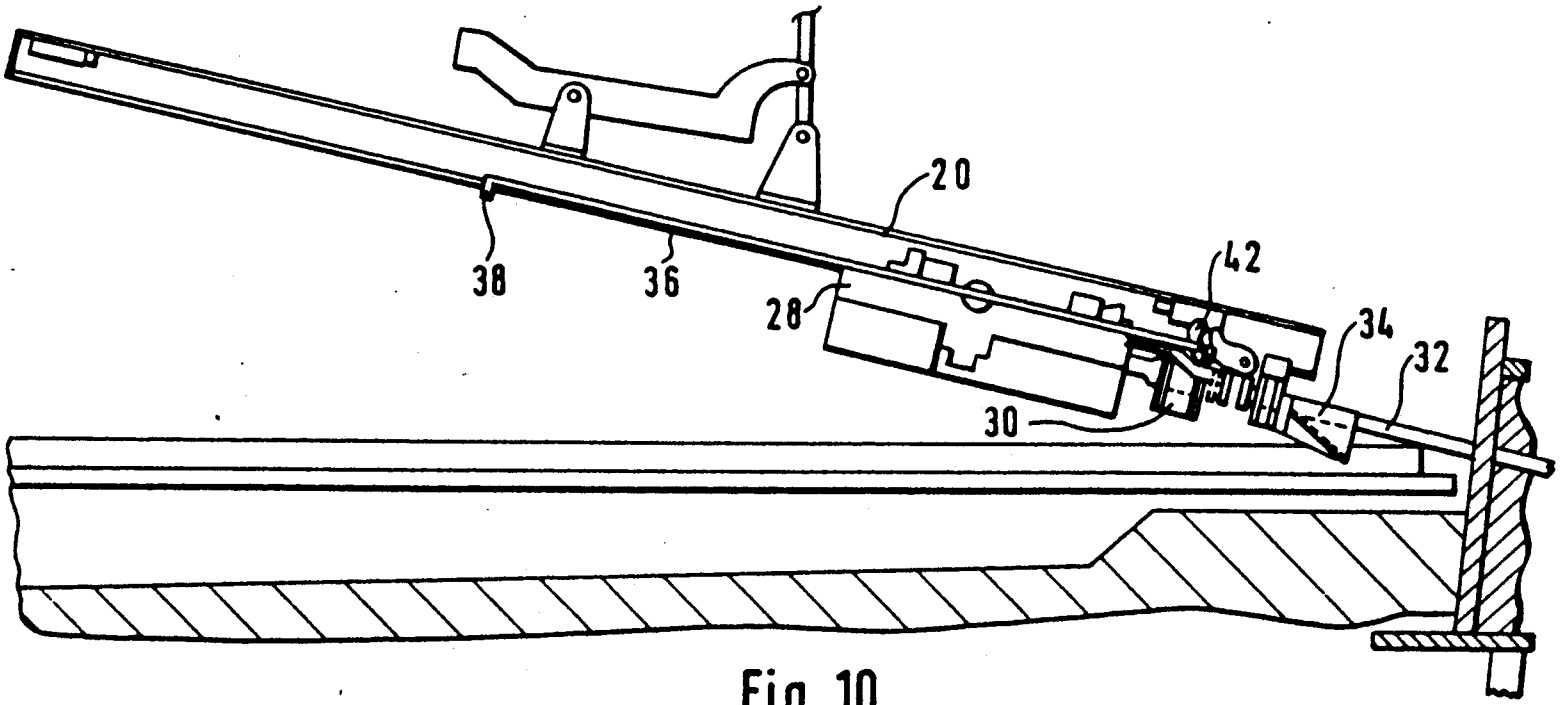
FIG. 10 is side view similar to that of FIG. 9 after the coupling of the working tool to the drilling machine.
Figure 11:
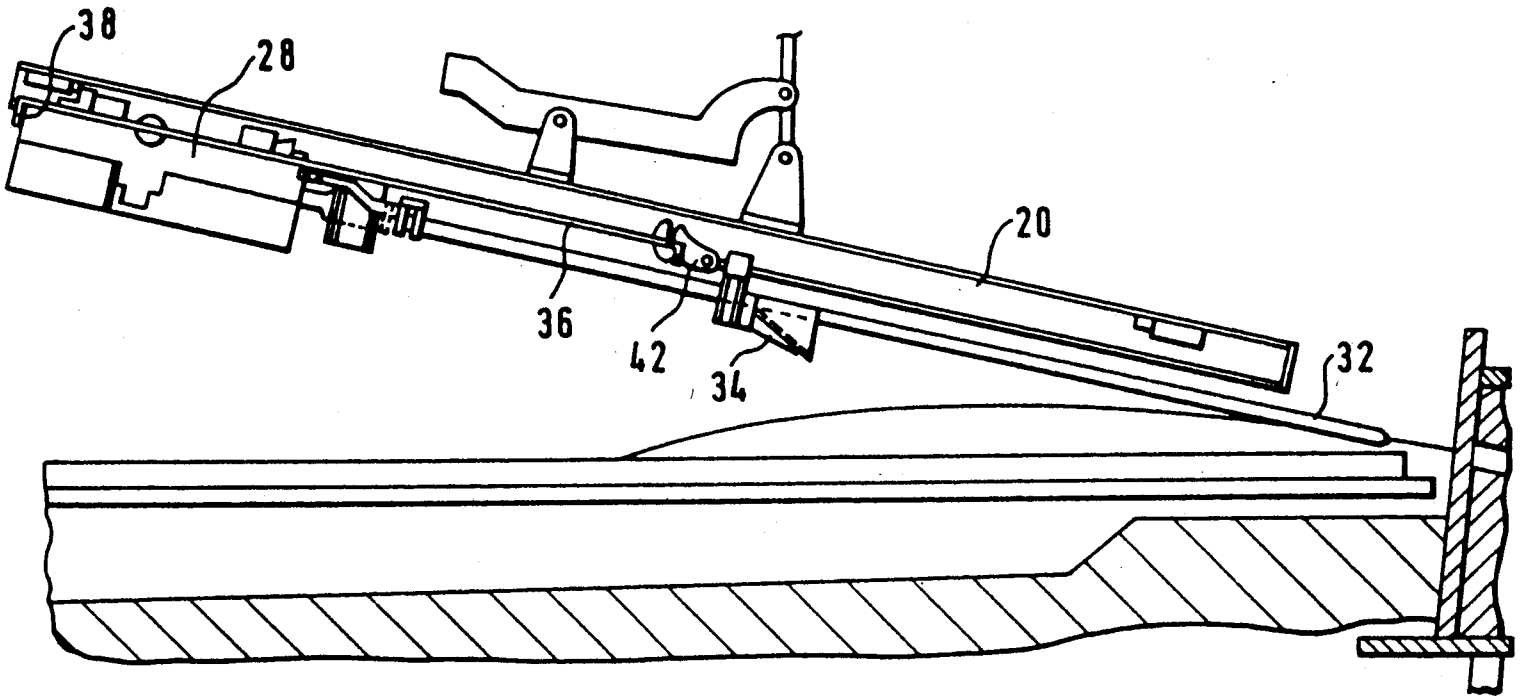
FIG. 11 is a side view, similar to those of FIGS. 9 and 10, after the extraction of the drill rod.

The functioning of the machine in accordance with the present invention will now be explained in more detail with reference to FIGS. 9 to 11. In FIG. 9, the machine is in position for extracting a drill rod 32 from the wall of a shaft furnace and for thereby opening the taphole. The guide and support head 34 is in a retracted position caught by hook 42 on sliding frame 36 which, during the preceding operation (e.g., the introduction of the drill rod 32), was retracted as a result of the action of carriage 28 on stop 38. It can be seen that, in this position, head 34 does not risk striking against the end of rod 32 during the positioning of mount 20. It would be otherwise if head 34 was still located at the front end of the mount 20.

To extract drill rod 32, carriage 28 is moved forwards. During a first phase, sliding frame 36 remains in place, and only from the moment when carriage 28 comes into engagement on stop 40 of frame 36 is the latter pushed by carriage 28 into the position illustrated in FIG. 10. The small errors of alignment between the axis of drill rod 32 and that of the coupling device 30 are corrected during the engagement of the conical part of head 34 onto rod 32, thus making it possible to obtain the best possible centering followed by the coupling of rod 32 to device 30. From that moment, the extraction of rod 32 can be carried out by causing the return of carriage 28 which, in its movement, will drive sliding frame 36 together with hook 42 and head 34, as shown in FIG. 11. For the introduction of a new rod 32, it is preferable to release head 34 from frame 36 and push it manually towards the front end of mount 20, so that it can support the front end of drill rod 32 more effectively. However, the positions of hooks 42, 42' are not changed, thus allowing them to catch automatically on frame 36 during the advance of carriage 28 for introducing rod 32, as explained with reference to FIG. 4. This automatic catching of head 34 on frame 38 ensures that head 34 resumes the position of FIG. 9 when carriage 28 returns to its retracted position, after rod 32 has been introduced.

It is also necessary, from time to time, to carry out conventional drilling by means of a bit with a drill ring. During such drilling, it is preferable for head 34 to be in the front position to ensure good support of bit 32. For this purpose, the head is released from sliding frame 36 and secured to the front end of mount 20 by rotating hooks 42, 42' manually in the manner shown in FIG. 7.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An improved apparatus for opening taphole of a shaft furnace, said apparatus including a mount, said mount being attached to the free end of a pivoting support arm and having a front end, a carriage slidably secured to the mount, a working tool mounted on said carriage, and means for coupling a drill rod to the working tool, said apparatus being designed for both conventional drilling and carrying out a process wherein the closing and opening of the taphole involve, respectively, introducing and extracting a drillrod which is left in the taphole between the successive pourings, wherein the improvement comprises:

a frame slidably mounted on said mount and displaceable along said mount by said carriage; and head means, slidably mounted on said mount, for guiding and supporting said drill rod, said head means including a pivotably mounted first hook, said first hook having opposed first and second catch slots and said hook being pivotable between a first catch position wherein the head means is secured to the frame and a second catch position wherein the head means is secured to the front end of the mount.

2. The apparatus of claim 1, wherein the head means further comprises:

a transverse shaft; and a second hook and wherein the first and second hooks are identical and are each mounted on said shaft.

3. The apparatus of claim 1, wherein said frame comprises:

cross bar means for engaging one of said slots of said first hook;

support means for slidably mounting said frame on said mount; and limit means, at opposite ends of said frame, for contacting the carriage.

4. An apparatus according to claim 3, wherein the hook includes a sloped surface which interacts with said crossbar means to lift said hook so that said hook automatically engages said crossbar means.

5. The apparatus of claim 1 wherein the hook includes handle means for manually pivoting said hook between said first and second catch positions.

* * * * *

UNITED STATES PATENT AND TRADEMARK OFFICE

CERTIFICATE OF CORRECTION

PATENT NO. : 5,039,068

DATED : Aug. 13, 1991

INVENTOR(S) : Severino Venturini, et al

It is certified that error appears in the above-identified patent and that said Letters Patent is hereby corrected as shown below:

Col. 2, line 44, Delete "10" after "in" and before "FIG. 4".

Col. 2, line 50 Between "is" and "side" insert --a--.

Col. 3, line 31, After "hooks", delete "42,42" and insert therefore -- 42,42'--.

Col. 3, line 36, After "Hooks", delete "42,42" and insert therefore -- 42,42'--.

Col. 3, line 42, After hooks", delete "42,42" and insert therefore -- 42,42'--.

Signed and Sealed this

Third Day of August, 1993

*Attest:*

Michael K. Kirk

MICHAEL K. KIRK

*Attesting Officer*

*Acting Commissioner of Patents and Trademarks*